US011306966B2

(12) United States Patent
Schroeder et al.

(10) Patent No.: US 11,306,966 B2
(45) Date of Patent: Apr. 19, 2022

(54) REFRIGERATOR APPLIANCE AND VARIABLE SHELF ASSEMBLY

(71) Applicant: Haier US Appliance Solutions, Inc., Wilmington, DE (US)

(72) Inventors: Michael Goodman Schroeder, Louisville, KY (US); Matthew Hunter, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 303 days.

(21) Appl. No.: 16/529,114

(22) Filed: Aug. 1, 2019

(65) Prior Publication Data

US 2021/0033336 A1 Feb. 4, 2021

(51) Int. Cl.
*F25D 25/02* (2006.01)

(52) U.S. Cl.
CPC ..... *F25D 25/02* (2013.01); *F25D 2325/021* (2013.01)

(58) Field of Classification Search
CPC .. F25D 25/02; F25D 2325/021; F25D 23/067; F25D 2325/022; F25D 11/00; F25D 25/04; F25D 25/024; A47B 96/025; A47B 2210/175; A47B 96/021; A47B 96/027; A47B 96/02; A47B 57/06; A47B 96/062; A47B 9/10; A47B 21/02; A47B 57/30
USPC ..... 62/291
See application file for complete search history.

(56) References Cited

U.S. PATENT DOCUMENTS 2,077,739 A 4/1937 Bryant
4,522,040 A * 6/1985 Ochiai ..... F25D 23/003 62/419
4,843,835 A * 7/1989 Goetz ..... F25D 21/14 62/285
5,573,323 A * 11/1996 Kim ..... F25D 17/047 312/405
5,913,584 A * 6/1999 Swindell ..... F25D 25/02 312/408
7,810,891 B2 10/2010 Lee et al.
(Continued)

FOREIGN PATENT DOCUMENTS

CN 1987309 A * 6/2007 ..... F25D 25/02
CN 205619681 U 10/2016
JP 2000226193 A * 8/2000

OTHER PUBLICATIONS

English translation of CN205619681 (Year: 2016).*

*Primary Examiner* — Hiwot E Tefera
(74) *Attorney, Agent, or Firm* — Dority & Manning, P.A.

(57) ABSTRACT

A refrigerator appliance or a variable shelf assembly, as provided herein, may include a selectively-sealed shelf tube, a support piston, a shelving bracket, a first valve, and a second valve. The selectively-sealed shelf tube may define a fluid inlet to receive water therethrough and a fluid outlet to exhaust water therethrough. The support piston may be slidably disposed within the selectively-sealed shelf tube to move between a top position and a base position according to a volume of water within the selectively-sealed shelf tube. The shelving bracket may be fixed to the support piston to move therewith. The first valve may be upstream from the fluid inlet to selectively permit water thereto. The second valve may be downstream from the fluid outlet to selectively permit water from the variable shelf assembly.

16 Claims, 5 Drawing Sheets

(56) References Cited

U.S. PATENT DOCUMENTS

| | | | | |
|---|---|---|---|---|
| 8,172,347 | B2 * | 5/2012 | Lim | F25D 25/02 312/408 |
| 10,962,279 | B1 * | 3/2021 | Scalf | F25D 23/04 |
| 2004/0263037 | A1 * | 12/2004 | Ritchie | F25D 25/024 312/405.1 |
| 2009/0159611 | A1 * | 6/2009 | Roetker | B67D 1/0858 222/1 |
| 2015/0323244 | A1 * | 11/2015 | Marts | A47B 57/485 312/408 |
| 2016/0047594 | A1 * | 2/2016 | Choo | F25D 23/00 312/404 |
| 2018/0259245 | A1 * | 9/2018 | Abeygunawardana | F25D 25/04 |
| 2019/0075924 | A1 * | 3/2019 | Nuss | A47B 57/06 |

* cited by examiner

REFRIGERATOR APPLIANCE AND VARIABLE SHELF ASSEMBLY

FIELD OF THE INVENTION

The present subject matter relates generally to domestic appliances, and more particularly to a variable shelf assembly to adjust the height of a shelf in a refrigerator appliance.

BACKGROUND OF THE INVENTION

Domestic appliances, such as refrigerator appliances, generally include a cabinet that defines an internal chamber. In the case of refrigerator appliances, a chilled chamber may be defined for receipt of food articles for storage. Refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber.

Some existing refrigerator appliances include one or more shelves for holding or supporting food items within the chilled chamber. The height or position of the shelf or shelves may be changed according to the needs of a user. For instance, a shelf may be removably supported on a bracket that is permanently fixed to the refrigerator. Multiple predetermined mounting heights may be defined on the bracket by slots that receive the shelf. In order to change the height of the shelf, the shelf must be removed from the bracket. Generally, this requires a user to pivot or lift the shelf relative to the bracket. Moreover, the shelf must be at least partially removed from the chilled chamber.

The steps required for adjusting the height of such existing systems can be undesirably complicated. For instance, any food items held or supported by the shelf must generally be removed before the shelf may be adjusted. If the food items are not first removed, a user risks spilling or dropping the items while the shelf is unsupported by the bracket. Even if all the food items are removed, properly aligning the shelf to the bracket may be difficult for some users. Furthermore, the shelf will have only a limited number of predetermined heights, as determined by the bracket. This, in turn, limits a user's options for configuring the shelf height, as well as the overall useable space within the chilled chamber.

Accordingly, an appliance with features for easily and reliably adjusting a shelf height within the appliance would be useful. In particular, a refrigerator appliance with features for easily varying the height of a shelf while mounted within a refrigerator appliance would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet, a liner, and a variable shelf assembly. The liner may be positioned within the cabinet. The liner may define a refrigerated chamber. The variable shelf assembly may be mounted within the refrigerated chamber. The variable shelf assembly may include a selectively-sealed shelf tube, a support piston, a shelving bracket, a first valve, and a second valve. The selectively-sealed shelf tube may define a fluid inlet to receive water therethrough and a fluid outlet to exhaust water therethrough. The support piston may be slidably disposed within the selectively-sealed shelf tube to move between a top position and a base position according to a volume of water within the selectively-sealed shelf tube. The shelving bracket may be fixed to the support piston to move therewith. The first valve may be upstream from the fluid inlet to selectively permit water thereto. The second valve may be downstream from the fluid outlet to selectively permit water from the variable shelf assembly.

In another exemplary aspect of the present disclosure, a variable shelf assembly for a refrigerated chamber is provided. The variable shelf assembly may include a selectively-sealed shelf tube, a support piston, a shelving bracket, a first valve, and a second valve. The selectively-sealed shelf tube may define a fluid inlet to receive water therethrough and a fluid outlet to exhaust water therethrough. The support piston may be slidably disposed within the selectively-sealed shelf tube to move between a top position and a base position according to a volume of water within the selectively-sealed shelf tube. The shelving bracket may be fixed to the support piston to move therewith. The first valve may be upstream from the fluid inlet to selectively permit water thereto. The second valve may be downstream from the fluid outlet to selectively permit water from the variable shelf assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
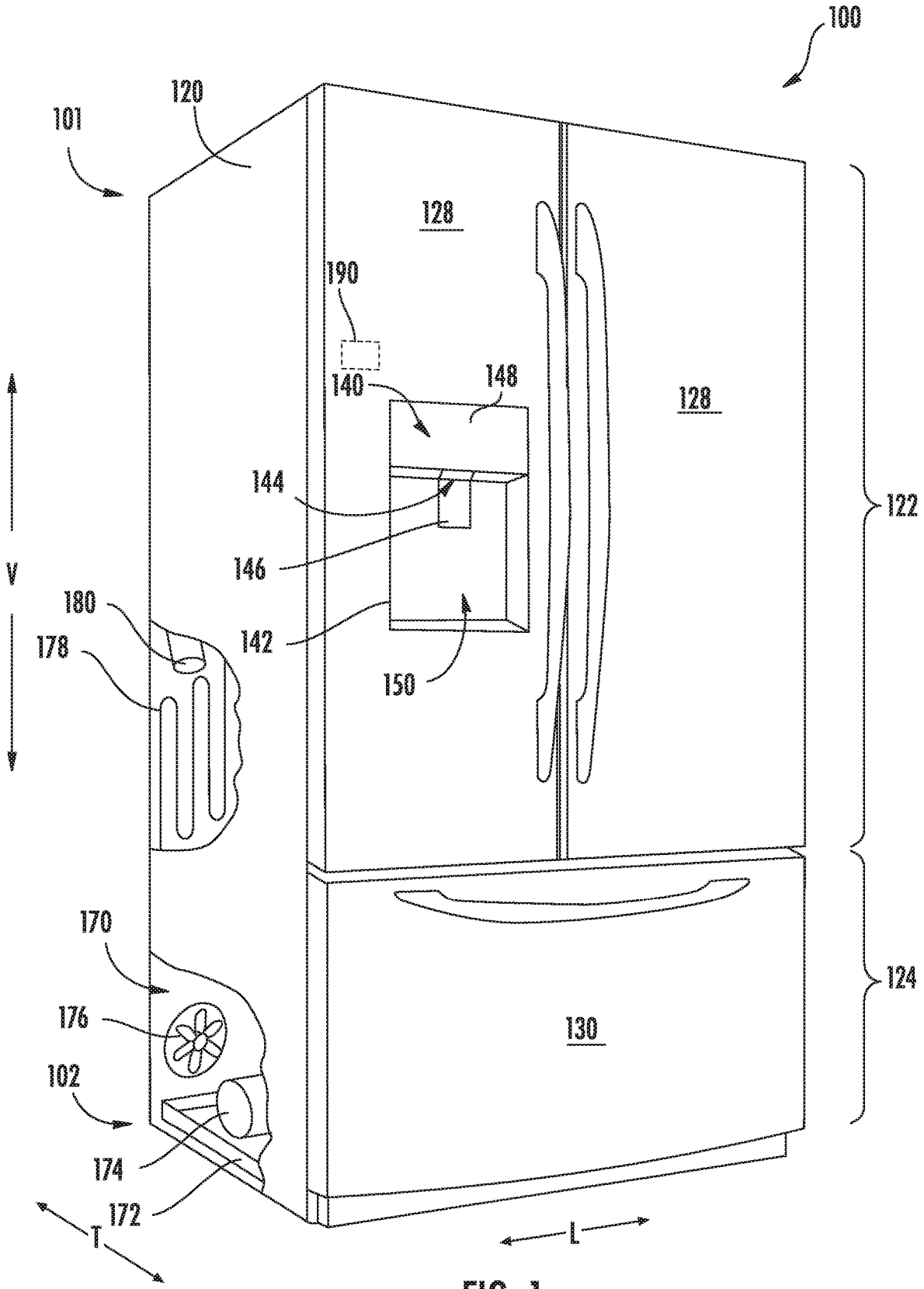
FIG. 1 provides a perspective view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Generally, the present disclosure provides an appliance that has a variable shelf assembly. When assembled, the variable shelf assembly may be raised or lowered without being removed from the appliance. The variable shelf assembly may include a selectively-sealed shelf tube within which a support piston may slide. Water may be added to or released from the selectively-sealed shelf tube to adjust the height of the support piston. Specifically, to raise the support piston, water may be added directly from a water source, such as a municipal water source, without requiring a secondary booster pump. The selectively-sealed shelf tube may be positioned along an open fluid path so that water is not recirculated through the selectively-sealed shelf tube. To lower the support piston, water may thus be removed from the cylinder and discarded.

Figure 2:
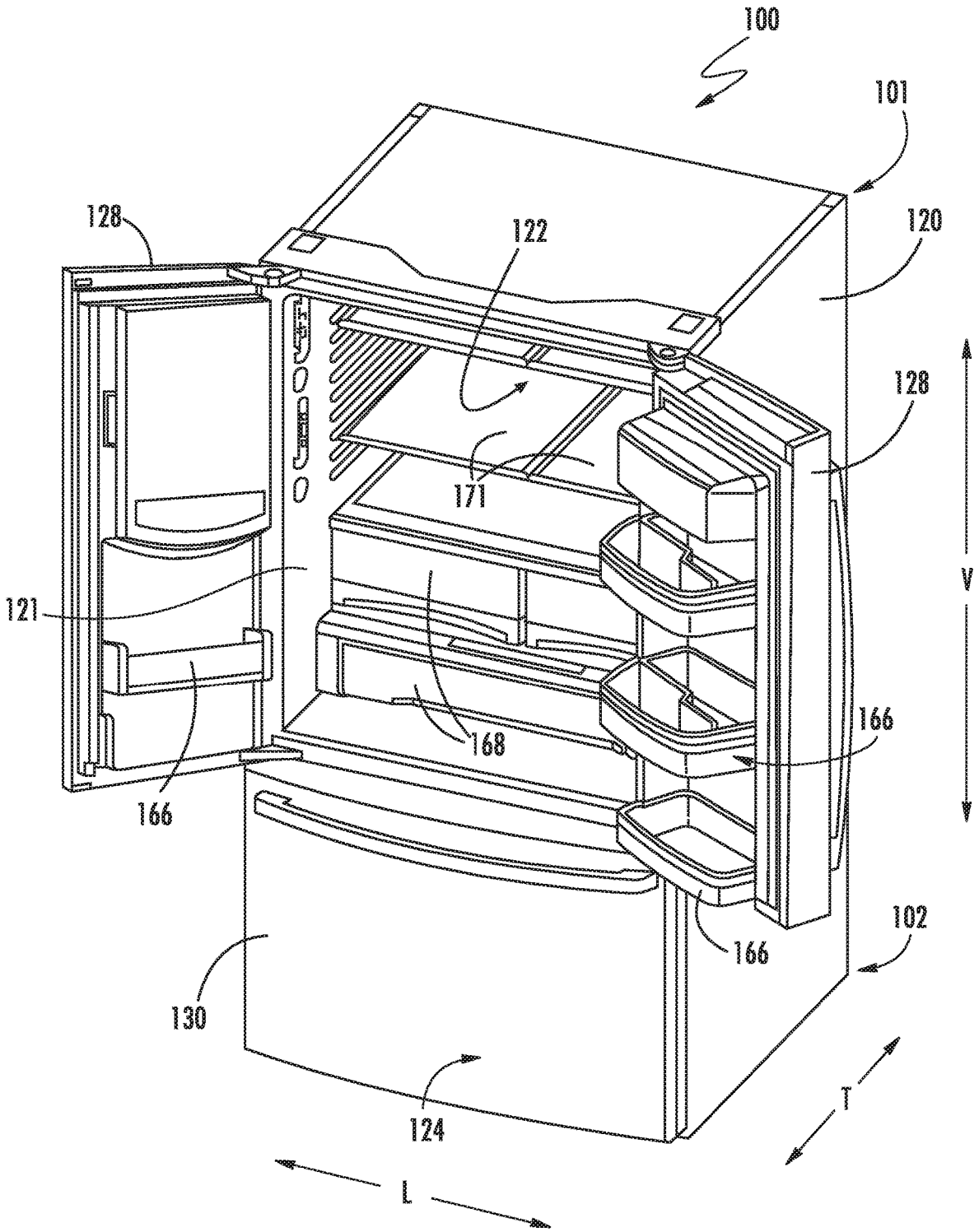
FIG. 2 provides a perspective view of the exemplary refrigerator appliance of FIG. 1, wherein refrigerator doors of the refrigerator appliance are in an open position to reveal a fresh food chamber of the refrigerator appliance.

Turning now to the figures, FIGS. 1 and 2, FIG. 1 provides a perspective view of a refrigerator appliance 100 according to exemplary embodiments of the present disclosure. FIG. 2 provides a perspective view of refrigerator appliance 100 having multiple refrigerator doors 128 in the open position. As shown, refrigerator appliance 100 includes a housing or cabinet 120 that extends between a top 101 and a bottom 102 along a vertical direction V. Cabinet 120 also extends along a lateral direction L and a transverse direction T, each of the vertical direction V, lateral direction L, and transverse direction T being mutually perpendicular to one another. In turn, vertical direction V, lateral direction L, and transverse direction T defines an orthogonal direction system.

Cabinet 120 includes a liner 121 that defines one or more chilled chambers for receipt of food items for storage. In particular, liner 121 defines a fresh food chamber 122 positioned at or adjacent top 101 of cabinet 120 and a freezer chamber 124 arranged at or adjacent bottom 102 of cabinet 120. As such, refrigerator appliance 100 is generally referred to as a bottom mount refrigerator. It is recognized, however, that the benefits of the present disclosure apply to other types and styles of appliances such as (e.g., a top mount refrigerator appliance, a side-by-side style refrigerator appliance, or a range appliance). Consequently, the description set forth herein is for illustrative purposes only and is not intended to be limiting in any aspect to any particular refrigerator chamber configuration.

Refrigerator doors 128 are rotatably hinged to an edge of cabinet 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

In some embodiments, refrigerator appliance 100 also includes a dispensing assembly 140 for dispensing liquid water or ice. Dispensing assembly 140 includes a dispenser 142 positioned on or mounted to an exterior portion of refrigerator appliance 100 (e.g., on one of refrigerator doors 128). Dispenser 142 may include a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A control panel 148 is provided for controlling the mode of operation. For example, control panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open refrigerator doors 128.

According to the illustrated embodiment, various storage components are mounted within fresh food chamber 122 to facilitate storage of food items therein as will be understood by those skilled in the art. In particular, the storage components include storage bins 166, drawers 168, and shelves 171 that are mounted within fresh food chamber 122. Storage bins 166, drawers 168, and shelves 171 are configured for receipt of food items (e.g., beverages or solid food items) and may assist with organizing such food items. As an example, drawers 168 can receive fresh food items (e.g., vegetables, fruits, or cheeses) and increase the useful life of such fresh food items.

In exemplary embodiments, chilled air from a sealed system of refrigerator appliance 100 may be directed into one or more chambers (e.g., fresh food chamber 122 or freezer chamber 124) in order to cool refrigerator appliance. For example, an evaporator 178 is generally configured for generating cooled or chilled air. Optionally, a supply conduit 180 (e.g., defined by or positioned within cabinet 120) may extend between evaporator 178 and one or more chilled chambers to direct air thereto.

In some embodiments, liquid water is collected within a portion of refrigerator appliance 100. For example, liquid water may be generated during melting of frost or from ice cubes being stored within an ice storage bin, as is understood. In certain embodiments, liquid water is directed to an evaporation pan 172. Evaporation pan 172 is positioned within a mechanical compartment 170 defined by cabinet 120 (e.g., at bottom portion 102 of cabinet 120). A condenser 174 of the sealed system can be positioned, for example, directly, above and adjacent evaporation pan 172. Heat from condenser 174 can assist with evaporation of liquid water in evaporation pan 172. A fan 176 configured for cooling condenser 174 can also direct a flow air across or into evaporation pan 172. Thus, fan 176 can be positioned above and adjacent evaporation pan 172. Evaporation pan 172 may be sized and shaped for facilitating evaporation of liquid water therein. For example, evaporation pan 172 may be open topped and extend across about a width or a depth of cabinet 120.

Generally, operation of the refrigerator appliance 100 can be regulated by a controller 190 that is operatively coupled to user interface panel 148 or various other components. User interface panel 148 provides selections for user manipulation of the operation of refrigerator appliance 100, such as selections between whole or crushed ice, chilled water, or other various options (e.g., the height of one or more variable shelves). In response to user manipulation of user interface panel 148 or one or more sensor signals, controller 190 may operate various components of the refrigerator appliance 100. Controller 190 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor (e.g., using a combination of discrete analog or digital logic circuitry—such as switches, amplifiers, integrators, comparators, flip-flops, AND gates, and the like) to perform control functionality instead of relying upon software.

Controller 190 may be positioned in a variety of locations throughout refrigerator appliance 100. In the illustrated embodiment, controller 190 is located adjacent to or on user interface panel 148. In other embodiments, controller 190 may be positioned at another suitable location within refrigerator appliance 100, such as for example within a fresh food chamber, a freezer door, etc. Input/output ("I/O") signals may be routed between controller 190 and various operational components of refrigerator appliance 100. For example, user interface panel 148 may be in operable communication (e.g., electrical communication) with controller 190 via one or more signal lines or shared communication busses.

Figure 4:
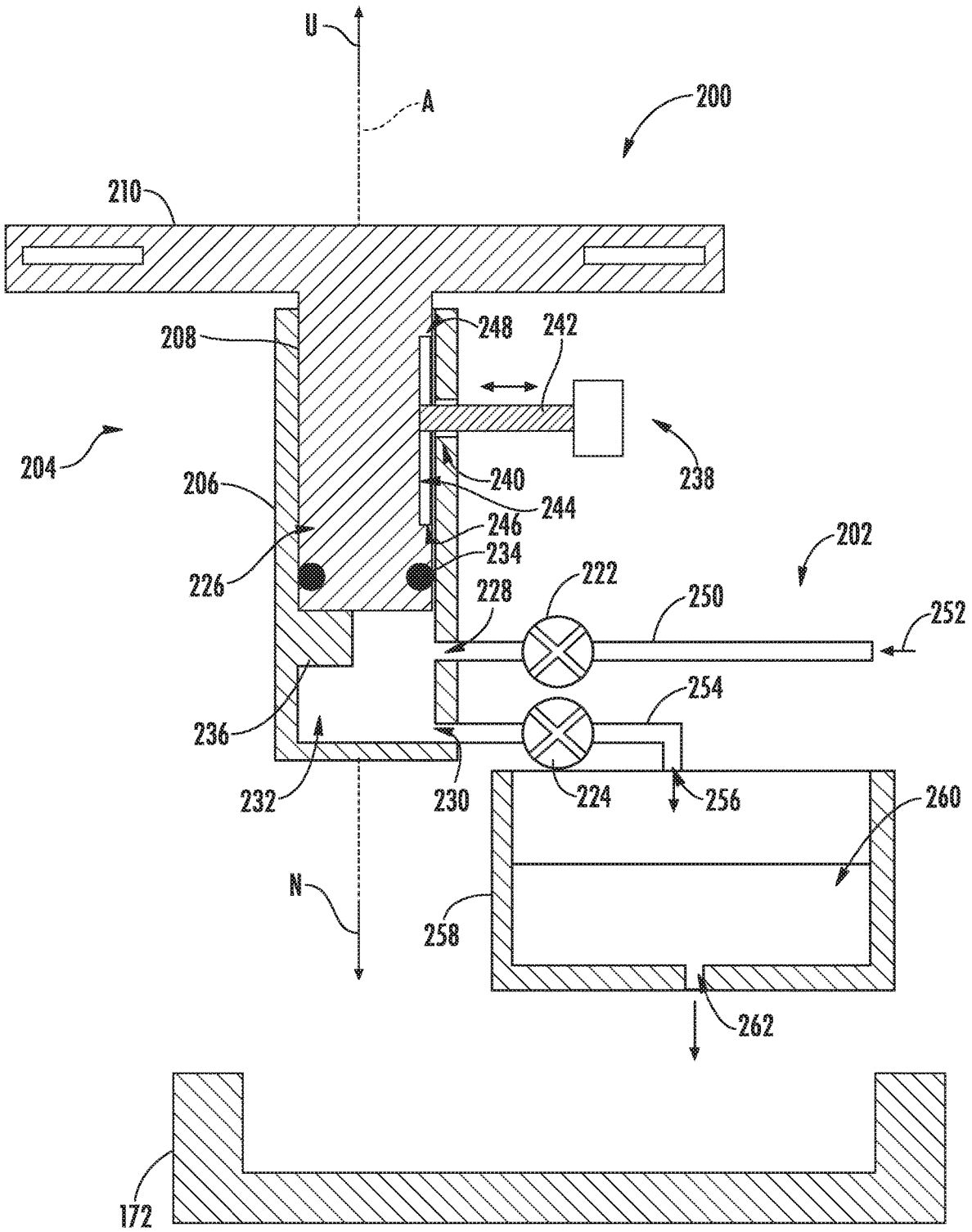
FIG. 4 provides a schematic elevation view of the exemplary variable shelf assembly of FIG. 3.

As will be described in detail below, controller 190 may be operatively coupled with the various components of a variable shelf assembly 200 (FIG. 4). Generally, the relative height or position of the variable shelf assembly 200 may be varied or adjusted according to one or more signals received from controller 190. As discussed, interface panel 148 may additionally be operatively coupled (e.g., via electrical or wireless communication) with controller 190. Thus, the height (e.g., changes thereto) of the variable shelf assembly 200 may be based, at least in part, on user inputs received at interface panel 148.

Figure 3:
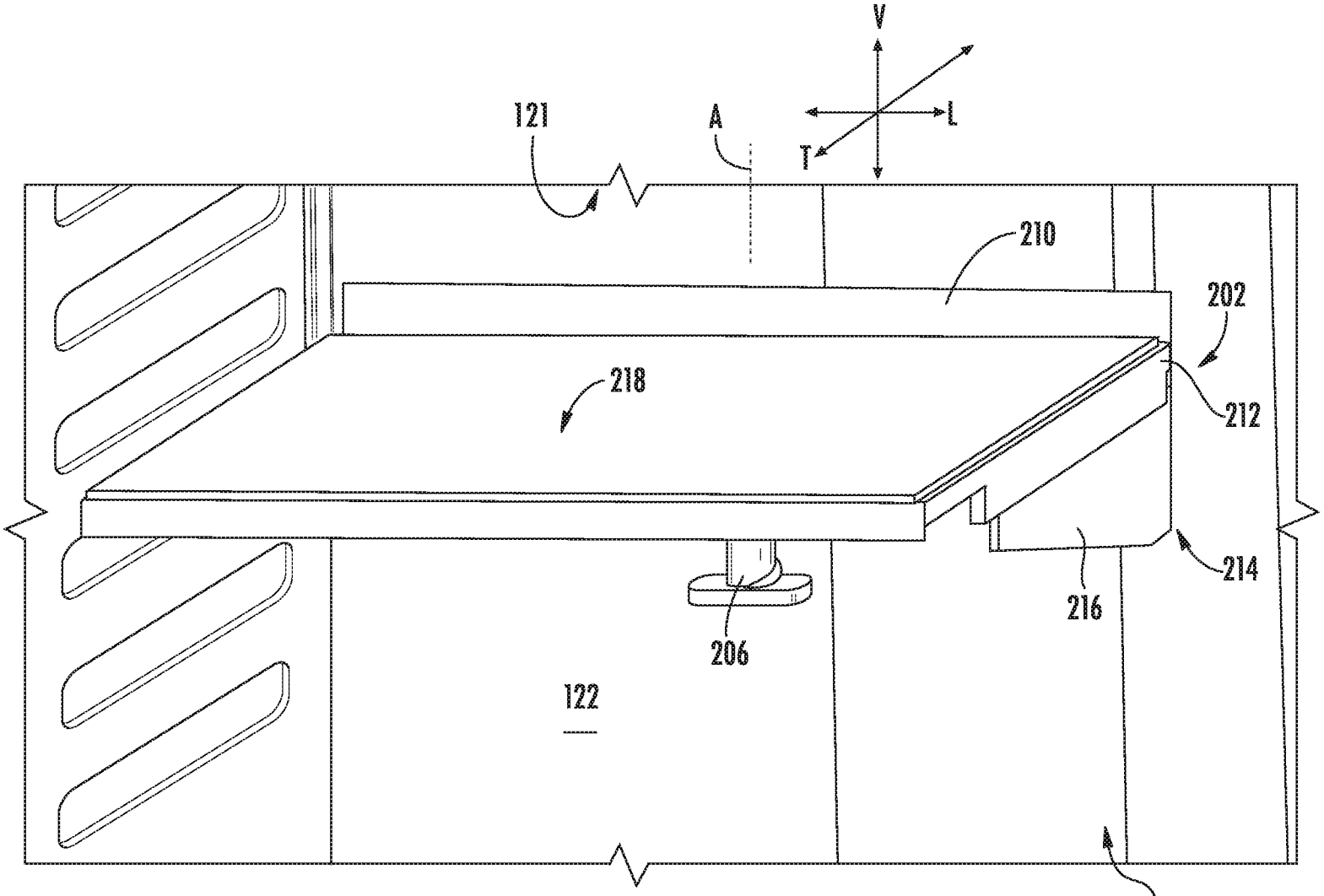
FIG. 3 provides a top perspective of a portion of the fresh food chamber of the example refrigerator appliance of FIG. 1, including a variable shelf assembly according to exemplary embodiments of the present disclosure.

Turning now to FIGS. 3 and 4, a variable shelf assembly 200 is illustrated within fresh food chamber 122. When assembled, variable shelf assembly 200 may be mounted to a portion of liner 121 (e.g., at a back wall of liner 121). It is understood that variable shelf assembly 200 may include, or be provided as, one or more of shelves 171 (FIG. 2).

As shown, variable shelf assembly 200 generally includes a drive assembly 202 and a support assembly 204. Drive assembly 202 defines a movement axis A (e.g., at a stationary shelf tub 206) along which support assembly 204 may move. Specifically, drive assembly 202 may motivate or at least partially control movement of support assembly 204 along movement axis A (e.g., relative to liner 121). As will be described in detail below, drive assembly 202 may alternately translate or slide support assembly 204 in an upward direction U and a downward direction N along movement axis A. Generally, upward direction U may extend above support assembly 204 while downward direction N extends below support assembly 204. When assembled, movement axis A may be parallel to the vertical direction V. Thus, drive assembly 202 may adjust the height of support assembly 204 within fresh food chamber 122.

When assembled, at least a portion of support assembly 204 is fixed relative to liner 121. Specifically, a selectively sealed shelf tube or cylinder 206 may be mounted within fresh food chamber 122. Shelf tube 206 may be attached to cabinet 120 (e.g., at liner 121) directly or through an intermediate mounting plate. One or more suitable adhesives, mechanical fasteners, or other attachment members may secure shelf tube 206 or the intermediate mounting plate, such as by forming a stable joint between shelf tube 206 and liner 121.

Within shelf tube 206, a support piston 208 is slidably disposed in operative communication with drive assembly 202. During use, support piston 208 may thus move along the axis A (e.g., in the upward direction U or downward direction N) relative to shelf tube 206 and liner 121 as directed by drive assembly 202.

In some embodiments, a shelving bracket 210 is attached to support piston 208 (e.g., to move therewith). Generally, shelving bracket 210 is fixed relative to, for example, a top portion of support piston 208 such that movement of support piston 208 along the movement axis A is transferred to shelving bracket 210. Optionally, shelving bracket 210 may include a brace 212 that extends (e.g., perpendicular to movement axis A). For instance, when assembled, brace 212 may generally extend in the lateral direction L between two end portions 214. One or more struts 216 may extend from brace 212 (e.g., away from liner 121 or toward the cabinet 120 opening selectively covered by doors 128—see FIG. 2). As an example, a strut 216 may extend from shelving bracket 210 or brace 212 in the transverse direction T. In some such embodiments, a discrete strut 216 extends in the transverse direction T from each end portion 214 of brace 212.

In exemplary embodiments, support assembly 204 includes a shelf or storage surface 218 attached to shelving bracket 210. When assembled, storage surface 218 is generally supported by shelving bracket 210. For instance, storage surface 218 may rest on top of shelving bracket 210 to move therewith (e.g., relative to movement axis A). Optionally, storage surface 218 may be fixed to shelving bracket 210 via one or more suitable adhesives, mechanical fasteners, or other attachment members. In certain embodiments, storage surface 218 is a planar surface that extends orthogonal to movement axis A. In turn, storage surface 218 may include a flat plate formed from a suitable rigid material, such as tempered glass, plastic, or metal.

Turning especially to FIG. 4, drive assembly 202 includes multiple valves in selective fluid communication with shelf tube 206. Specifically, shelf tube 206 defines an interior 226 (e.g., defined by a closed base plate and sidewall of shelf tube 206) that can receive or expel water based on the position of the valves 222, 224. In some embodiments, shelf tube 206 defines fluid inlet 228 fluid outlet 230 extending from the interior 226. As shown, the fluid inlet 228 is downstream from the first valve 222. Water may thus be received through the fluid inlet 228 from the first valve 222 (e.g., when the first valve 222 is in an open position). In other words, the first valve 222 may be upstream from the fluid inlet 228 to selectively permit water thereto. Separate from the fluid inlet 228, a fluid outlet 230 is defined upstream from the second valve 224. Water may thus be exhausted from shelf tube 206 through the fluid outlet 230 and to the second valve 224 (e.g., when the second valve 224 is in an open position). In other words, the second valve 224 may be downstream from the fluid outlet 230 to selectively permit water from shelf tube 206.

In some embodiments, the interior 226 of shelf tube 206 includes a variable water chamber 232 located below or beneath support piston 208. Within water chamber 232, a volume of water may be held (e.g., in support of support piston 208). Both the fluid inlet 228 and the fluid outlet 230 may extend from water chamber 232. As more water is supplied to water chamber 232, the size or volume of water chamber 232 may increase, thereby motivating or moving support piston 208 and the upward direction U. By contrast, as water is exhausted from water chamber 232, the size or volume of water chamber 232 may decrease, thereby permitting or moving support piston 208 in the downward direction D. According to the volume of water within shelf tube 206 (e.g., at variable water chamber 232) the height or relative vertical position of support piston 208 may be set. Specifically, support piston 208 moves within shelf tube 206 between a top position (i.e., uppermost position) and a base position (i.e., lowermost position). Optionally, one or more O-rings or gaskets 234 may be mounted on support piston 208 within interior 226, such as to contact or engagement inner surface of shelf tube 206. As support piston 208 slides within shelf tube 206 water may thus be held beneath the gasket 234 and prevented from rising above support piston 208. One or both of the fluid inlet 228 or the fluid outlet 230 may be defined at discrete locations below support piston 208 (e.g., in the base position). For instance, in the base position, support piston 208 may be above both the fluid inlet 228 and the fluid outlet 230. Additionally or alternatively, the fluid outlet 230 may be defined at a location below the fluid inlet 228.

In certain embodiments, a piston backstop 236 is included within the interior 226 of shelf tube 206. For instance, piston backstop 236 may extend from an inner surface of shelf tube 206 within water chamber 232 (e.g., without sealing off any portion of variable water chamber 232). Generally, piston backstop 236 may be in selective engagement with support piston 208. For instance, piston backstop 236 may be located beneath at least a portion of support piston 208. In the base position, support piston 208 may rest on piston backstop 236 above at least a portion of the interior 226. Thus, piston backstop 236 may define the base position and a minimum volume of water chamber 232. In some such embodiments the fluid inlet 228 or the fluid outlet 230 may be defined at or below the height of the piston backstop 236. In certain embodiments, the fluid inlet 228 and the fluid outlet 230 both extend from water chamber 232 at discrete locations below the piston backstop 236.

Figure 5:
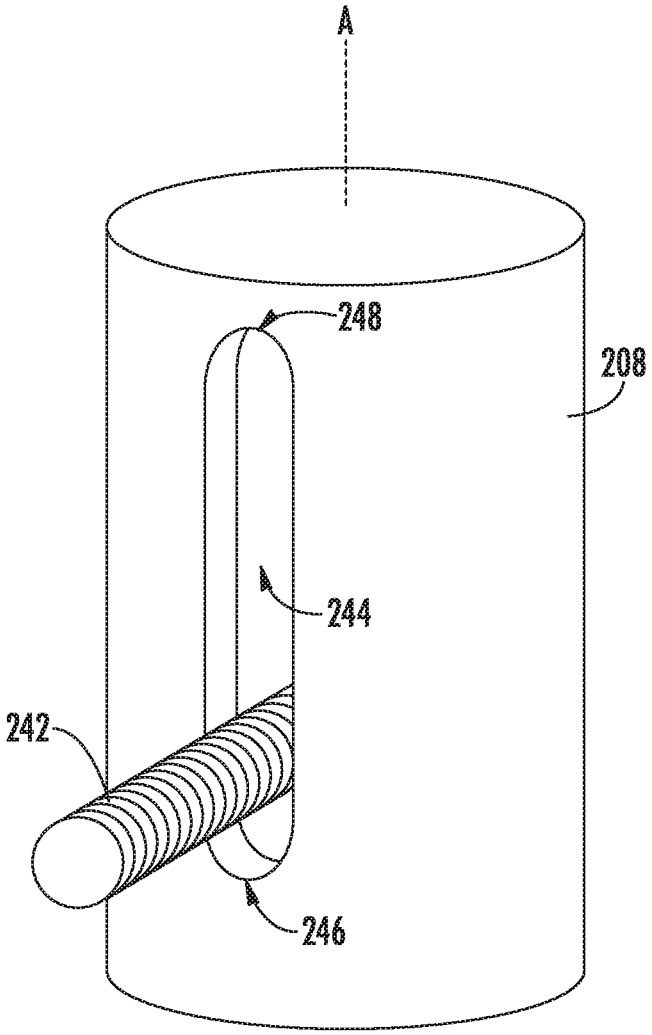
FIG. 5 provides a perspective view of a portion of a variable shelf assembly according to exemplary embodiments of the present disclosure.

Turning especially to FIGS. 4 and 5, in optional embodiments, a lock assembly 238 selectively holds or locks the height of support piston 208 within shelf tube 206. In some such embodiments, a sidewall aperture 240 is defined through a portion of shelf tube 206 (e.g., above water chamber 232) to receive a portion of the lock assembly 238. For instance, lock assembly 238 may include a clutch pin 242 in selective engagement or contact with a portion of support piston 208 through sidewall aperture 240. In certain embodiments, a complementary pin groove 244 is defined at an outer surface of support piston 208 (e.g., as a linear recess having a depth perpendicular to the movement axis A and a length defined along the vertical direction V). Engagement between clutch pin 242 and support piston 208 (e.g., at the pin groove 244) may lock or hold support piston 208 in a discrete position (i.e., at a discrete height). Thus, moving the clutch pin 242 away from support piston 208 and out of engagement therewith may release or unlock support piston 208, thereby allowing support piston 208 to move freely according to the volume of water within shelf tube 206.

In certain embodiments, clutch pin 242 is movable through sidewall aperture 240 along a direction perpendicular to movement axis A. Optionally, a motor (e.g., solenoid) may selectively move clutch pin 242 through sidewall aperture 240 and into/out of engagement with support piston 208 (i.e., between a locked position and an unlocked position). As shown, in the locked position, the clutch pin 242 may engage clutch pin 242 at a rear surface defining the depth of pin groove 244. By, contrast, in the unlocked position, the clutch pin 242 may be spaced apart from the rear surface. In some such embodiments, at least a portion of the clutch pin 242 may remain within the interior 226 in the unlocked position (e.g., between an upper end 248 of the pin groove 244 and a lower end 246 of the pin groove 244). Optionally, the clutch pin 242 may be held at a height to engage the upper end 248 or lower end 246 of the pin groove 244 (e.g., in the top position or the base position, respectively). Thus, movement of support piston 208 in the upward direction U or the downward direction D may be restricted by clutch pin 242 (e.g., in the unlocked position). Moreover, clutch pin 242 may help define the top position and the base position of support piston 208.

Returning especially to FIG. 4, as described above, water may be supplied to shelf tube 206 in order to raise or lift support piston 208. For instance, the first valve 222 may be moved to an open position while the second valve 224 is moved to a closed position. In such an arrangement, water may be permitted to the interior 226 of shelf tube 206 through fluid inlet 228 without exiting fluid outlet 230, thereby expanding the volume of water within variable water chamber 232.

In some embodiments, drive assembly 202 includes an inlet conduit 250 that extends to the first valve 222 (e.g., within cabinet 120) from a water source 252, such as a municipal water line or network connection point within a commercial or residential building. As is understood, water within such a water source 252 is generally pressurized (e.g., between 200 kPa and 500 kPa). In certain embodiments, the inlet conduit 250 extends uninterrupted to the first valve 222. Thus, between the water source 252 and the first valve 222 a flow path for water may be defined that is free of any active pressure-regulating or additive members, such as a booster pump or compressor. Moreover, the pressure of water in the first valve 222 may be substantially the same (e.g., within 10%) of the pressure of water entering the inlet conduit 250 or exiting the water source 252. Generally, the first valve 222 may thus be considered unpressurized. Similarly, the portion of the flow path between the first valve 222 in the fluid inlet 228 may be unpressurized such that no active pressure regulating components are required to supply water to the interior 226 of shelf tube 206. Advantageously, support piston 208 may be raised within shelf tube 206 without requiring activation of any active pumps or compressors.

As further described above, water may be exhausted or released from shelf tube 206 in order to lower support piston 208. For instance, the first valve 222 may be moved to a closed position while the second valve 224 is moved to an open position. In such an arrangement, water may be permitted from the interior 226 of shelf tube 206 through fluid outlet 230 without additional water being permitted through fluid inlet 228, thereby reducing the volume of water within variable water chamber 232.

In certain embodiments, a drain conduit 254 extends from the second valve 224 to a downstream terminal end 256. The terminal end 256 may reconnect to the water source 252 or, alternatively, be open to a surrounding environment (e.g., inside or outside of cabinet 120). Generally, at terminal end 256, water may exit the assembly 200 without being recirculated therethrough. Between the fluid outlet 230 and the second valve 224, the flow path of water may be free of any active pressure regulating components. Similarly, between the second valve 224 and the terminal end 256, the flow path of water may be free of any active pressure regulating components.

In exemplary embodiments, the terminal end 256 of the drain conduit 254 is positioned within cabinet 120. In some such embodiments, the terminal end 256 is held in or above the evaporation pan 172. Thus, the second valve 224 may be upstream from the evaporation pan 172. When the second valve 224 is open, water from shelf tube 206 may flow (e.g., as motivated by gravity or the pressure generated by the mass of support piston 208) to the evaporation pan 172. In the evaporation pan 172, water may be evaporated to the ambient environment, as described above.

In additional or alternative embodiments, the terminal end 256 of the drain conduit 254 is held in or above a surge tank 258. Generally, surge tank 258 defines a storage volume 260 within which water may be held (e.g., temporarily). Downstream from the storage volume 260, a relatively small tank outlet 262 is defined to permit water to flow from the surge tank 258. Thus, as water is released from the drain conduit 254, at least a portion of the water may collect within the storage volume 260 before being slowly released from the surge tank 258 through the tank outlet 262. Optionally, the surge tank 258, including the tank outlet 262, may be positioned upstream from the evaporation pan 172. For instance, the surge tank 258 may be held above the evaporation pan 172 with tank outlet 262 directed toward evaporation pan 172. As water drains from the tank outlet 262, it may thus flow to the evaporation pan 172.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet;

a liner positioned within the cabinet, the liner defining a refrigerated chamber;

a variable shelf assembly mounted within the refrigerated chamber, the variable shelf assembly comprising a selectively-sealed shelf tube defining a fluid inlet to receive water therethrough and a fluid outlet to exhaust water therethrough, a support piston slidably disposed within the selectively-sealed shelf tube to move between a top position and a base position according to a volume of water within the selectively-sealed shelf tube, a shelving bracket fixed to the support piston to move therewith, a first valve upstream from the fluid inlet to selectively permit water thereto, and a second valve downstream from the fluid outlet to selectively permit water from the variable shelf assembly;

an evaporation pan positioned within the cabinet apart from the liner; and a surge tank positioned within the cabinet above the evaporation pan, the surge tank defining a storage volume downstream from the second valve to receive water therefrom, the surge tank further defining a tank outlet downstream from the storage volume and upstream from the evaporation pan to permit water thereto.

2. The refrigerator appliance of claim 1, wherein the selectively-sealed shelf tube defines a variable water chamber below the support piston.

3. The refrigerator appliance of claim 2, wherein the selectively-sealed shelf tube comprises a piston backstop extending within the variable water chamber, the piston backstop being in selective engagement with the support piston in the base position to limit downward movement of the support piston.

4. The refrigerator appliance of claim 2, wherein the fluid inlet extends from the variable water chamber in fluid communication therewith below the support piston.

5. The refrigerator appliance of claim 2, wherein the fluid outlet extends from the variable water chamber in fluid communication therewith below the support piston.

6. The refrigerator appliance of claim 5, wherein the fluid inlet extends from the variable water chamber above the fluid outlet in fluid communication with the variable water chamber below the support piston.

7. The refrigerator appliance of claim 1, further comprising a condenser mounted on the evaporation pan.

8. The refrigerator appliance of claim 1, further comprising a drain conduit extending from the second valve to a terminal end positioned above the evaporation pan.

9. A variable shelf assembly for a refrigerated chamber, the variable shelf assembly comprising:

a selectively-sealed shelf tube defining a fluid inlet to receive water therethrough and a fluid outlet to exhaust water therethrough;

a support piston slidably disposed within the selectively-sealed shelf tube to move between a top position and a base position according to a volume of water within the selectively-sealed shelf tube;

a shelving bracket fixed to the support piston to move therewith;

a first valve upstream from the fluid inlet to selectively permit water thereto;

a second valve downstream from the fluid outlet to selectively permit water from the variable shelf assembly;

an evaporation pan positioned apart from the selectively-sealed shelf tube; and a surge tank positioned above the evaporation pan, the surge tank defining a storage volume downstream from the second valve to receive water therefrom, the surge tank further defining a tank outlet downstream from the storage volume and upstream from the evaporation pan to permit water thereto.

10. The variable shelf assembly of claim 9, wherein the selectively-sealed shelf tube defines a variable water chamber below the support piston.

11. The variable shelf assembly of claim 10, wherein the selectively-sealed shelf tube comprises a piston backstop extending within the variable water chamber, the piston backstop being in selective engagement with the support piston in the base position to limit downward movement of the support piston.

12. The variable shelf assembly of claim 10, wherein the fluid inlet extends from the variable water chamber in fluid communication therewith below the support piston.

13. The variable shelf assembly of claim 10, wherein the fluid outlet extends from the variable water chamber in fluid communication therewith below the support piston.

14. The variable shelf assembly of claim 13, wherein the fluid inlet extends from the variable water chamber above the fluid outlet in fluid communication with the variable water chamber below the support piston.

15. The variable shelf assembly of claim 9, further comprising a condenser mounted on the evaporation pan.

16. The variable shelf assembly of claim 9, further comprising a drain conduit extending from the second valve to a terminal end positioned above the evaporation pan.

* * * * *